US005160258A

United States Patent [19]

Karlsson

[11] Patent Number: 5,160,258

[45] Date of Patent: Nov. 3, 1992

[54] DEVICE AT A HEAT TREATMENT OVEN

[75] Inventor: Lars Karlsson, Onsala, Sweden

[73] Assignee: Triline AB, Molndal, Sweden

[21] Appl. No.: 588,347

[22] Filed: Sep. 26, 1990

[51] Int. Cl.[5] ..... F27B 9/04

[52] U.S. Cl. ..... 432/152; 432/155; 432/72; 432/181; 432/175; 126/91 A; 126/360 R

[58] Field of Search ..... 432/72, 147, 148, 175, 432/152, 155

[56] References Cited

U.S. PATENT DOCUMENTS

| | | | |
|---|---|---|---|
| 1,395,399 | 11/1921 | Doble | 126/360 R |
| 2,201,386 | 5/1940 | Woodson | 126/91 A |
| 2,281,206 | 4/1942 | Schoen | 126/91 A |
| 2,558,338 | 6/1951 | Clements | 432/152 |
| 2,632,503 | 3/1953 | Bailey | 126/91 A |
| 2,787,318 | 4/1957 | Wolfensperger | 126/91 A |
| 2,822,798 | 2/1958 | Ipsen | 126/91 A |
| 3,324,844 | 6/1967 | Huffman | 126/21 |
| 3,581,679 | 6/1971 | Jansen | 432/152 |
| 4,004,975 | 1/1977 | Lionetti et al. . | |
| 4,140,467 | 2/1979 | Ellison et al. | 432/72 |
| 4,189,911 | 4/1977 | Lionetti et al. . | |
| 4,217,090 | 8/1980 | Whike et al. | 432/72 |
| 4,217,091 | 8/1980 | Whike et al. | 432/72 |
| 4,514,167 | 4/1985 | Royer | 432/152 |
| 4,740,158 | 4/1988 | Johnson | 432/59 |
| 4,792,302 | 12/1988 | Baker et al. | 432/175 |
| 4,870,947 | 10/1989 | Kawamoto | 432/181 |
| 4,906,182 | 3/1990 | Moller | 432/152 |

FOREIGN PATENT DOCUMENTS

| | | |
|---|---|---|
| 0344743 | 12/1989 | European Pat. Off. . |
| WO85/02248 | 5/1985 | PCT Int'l Appl. . |
| WO87/01186 | 2/1987 | PCT Int'l Appl. . |
| 453222 | 1/1988 | Sweden . |
| 1530823 | 11/1978 | United Kingdom . |

*Primary Examiner*—Henry C. Yuen

*Attorney, Agent, or Firm*—Merchant & Gould, Smith, Edell, Welter & Schmidt

[57] ABSTRACT

A device at a heat treatment oven of the type using a combination of radiation heat and convection heat, and where in connection to the oven chamber are provided means (4, 19) arranged to circulate the oven atmosphere through the oven chamber and a channel (20, 21) situated outside the oven chamber and back to the oven chamber, whereby the device incorporates a gas burner (7) arranged at combustion to emit its flame in a direction, which at least partly touches or coincides with the circulation channel (20, 21) for the oven atmosphere, and where the gas burner (7) is arranged to direct its flame into a vessel (22), provided in the circulation channel (20, 21) for the circulating atmosphere.

5 Claims, 2 Drawing Sheets

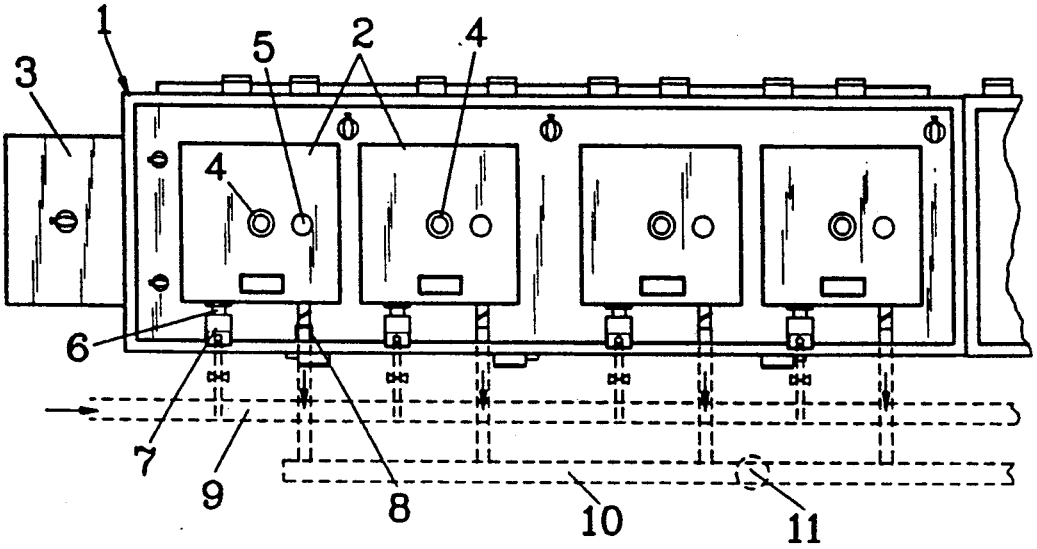
FIG. 2
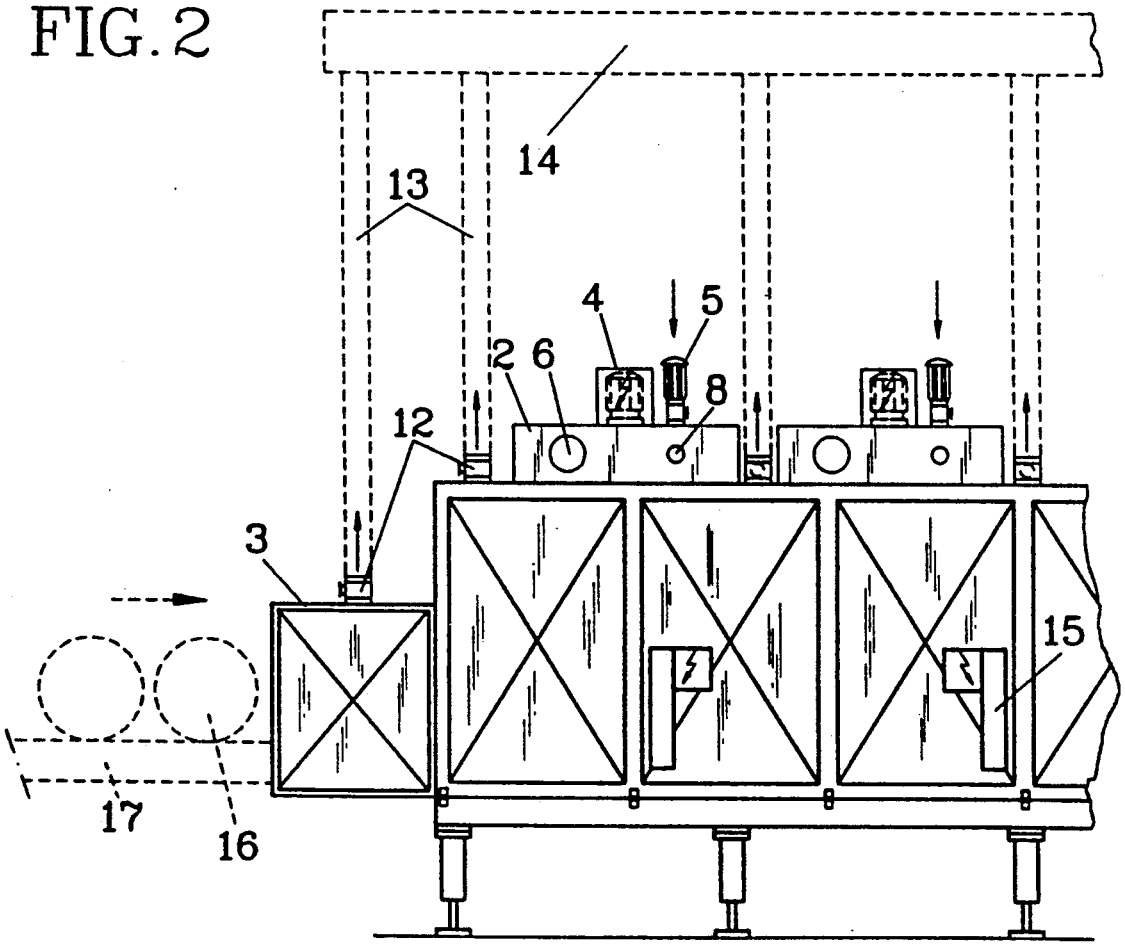

DEVICE AT A HEAT TREATMENT OVEN

BACKGROUND OF THE INVENTION

For heat treatment purposes of different types there have been developed different types of ovens for drying, hardening and food processing. An oven type, which has been developed in a number of different, well operating embodiments, during the last decade, is the IR-oven, which with a plurality of infrared radiators heat the goods to be treated in the oven. By particular steps it has hereby been possible to adapt the heating effect and the heat distribution in a desired manner, whereby ovens entirely or partly equipped with IR-elements, have proven themselves very well suited for many different purposes. For the purpose of combining the IR radiation with convection heating it has in certain types of ovens beside IR-elements in the oven walls also been provided an electric heating battery, which gives convection heating. This gives the heat treatment an improved flexibility, which is desirable in many connections.

PURPOSE AND MOST ESSENTIAL FEATURES OF THE INVENTION

During the years to come it is expected that electrical energy will be subjected to substantial price rises and it may even happen that there will be a shortage of electricity. On the other hand it is expected that supply and use of natural gas will increase substantially as the pipeline systems for natural gas is built out. For adaption to this expected new situation, the purpose of the present invention is to provide a device for reducing the electricity dependency of an IR-oven combined with convection heating of the aforesaid type and instead to use gas heating for the convection part of the heating, and this has been achieved at a heat treatment oven of the type using a combination of radiation heat and convection heat, and where in connection to the oven chamber are provided means arranged to circulate the oven atmosphere through the oven chamber and a channel situated outside the oven chamber and back to the oven chamber, whereby the device incorporates a gas burner arranged at combustion to emit its flame in a direction, which at least partly touches or coincides with the circulation channel for the oven atmosphere, wherein the gas burner is arranged to direct its flame into a vessel, provided in the circulation channel for the circulating atmosphere.

DESCRIPTION OF THE DRAWINGS

The invention hereinafter will be further described with reference to an embodiment illustrated in the accompanying drawings.

FIG. 1 shows in a view from above an oven portion according to the invention.

FIG. 2 is a side view of a part of the oven according to the invention.

DESCRIPTION OF PREFERRED EMBODIMENT

Figure 3:
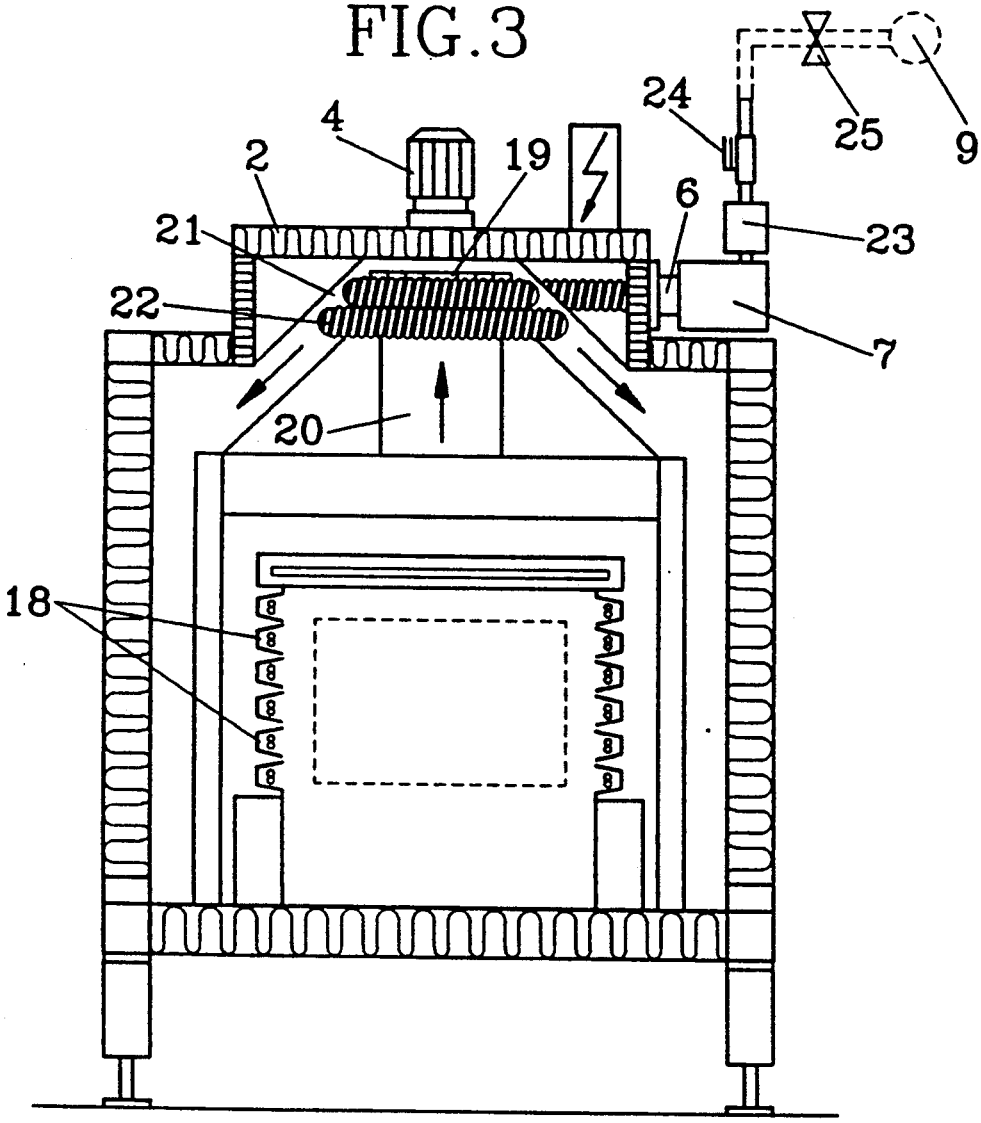
FIG. 3 shows in bigger scale a cross section through the oven according to the invention.

FIG. 1 shows from above a combined oven zone as a parallelepipedic housing 1 incorporating a number of oven sections 2, and an infeed lock-gate 3 provided at one end thereof. Each one of the oven sections 2 is provided with a blower motor 4, air inlet 5 and a connection 6 for a gas burner 7 and a fume outlet 8. All gas burners 7 are connected to a main gas conduit 9, whereas all fume outlets 8 are connected to a collecting duct 10 for fumes, in which duct is provided a fume fan 11, which during operation creates a suction effect at all fume outlets 8.

In FIG. 2 is shown a side view of a portion of the combined oven zone 1 according to FIG. 1. The gas burner, the gas conduit and the fume ducts have been omitted from this figure for the sake of clarity, whereas it instead is shown how the oven is equipped with a number of exhaust terminal devices 12, which via feed conduits 13 communicate with a main conduit 14 for exhaust air from the oven. In this view is also symbolically shown how the oven is equipped with electrical connections 15. At the infeed side is schematically shown how the objects 16, which shall travel through the oven for treatment, are conveyed into the oven e.g. on a conveyor track 17.

FIG. 3 shows a cross section through an oven chamber section 2 according to FIGS. 1 and 2, and as can be seen from this view the oven chamber walls are internally provided with IR-elements 18, which give a radiation heating of goods traveling through the oven chamber. The blower motor 4 positioned on top of the oven housing drives an impeller 19, which produces air circulation in the oven, whereby the oven atmosphere is caused to move upwards through a central air shaft 20, and thereafter downwards through a tapering, annular shaft 21 arranged concentric with the first central air shaft 20, and through which annular shaft the air is again introduced into the oven chamber through not shown slots provided in the oven walls, and from the bottom of the oven chamber through said central shaft 20, for a repeated closed cycle. In the tapering, annular shaft 21 is provided a coiled tube 22, having one of its ends is connected to the connection 6 for the gas burner 7, whereas its opposite end is connected to the connection 8, shown in FIG. 1, leading to the main fume conduit.

The gas burner 7 is connected to the main gas conduit 9 via a gas valve 23, a stop valve 24 and a reduction valve 25. The fume outlet, which is not shown in the figure, as earlier mentioned, communicates with a main fume conduit (10 in FIG. 1) in which is provided a fume fan 11, which creates a suction at the connection 8.

Figure 4:
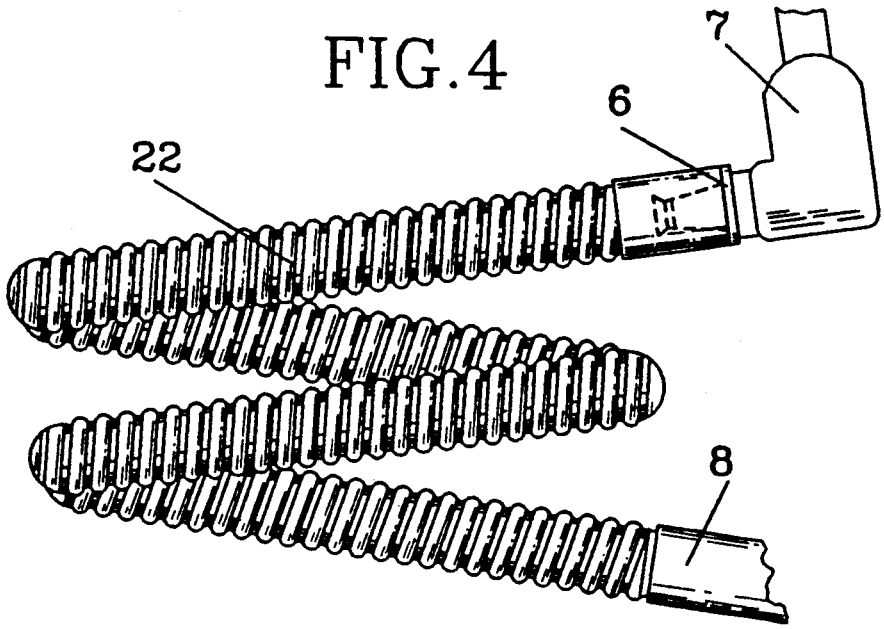
FIG. 4 is a schematical detail view, partly in section of the oven according to the invention.

FIG. 4 shows schematically, in perspective and in bigger scale the coiled tube 22 with its connections 6 and 8 to the gas burner 7 and to the fume outlet resp. As can be seen from this view the tube 22 is corrugated and it is of course manufactured from a material, which is not destroyed or influenced by the temperatures created by the gas burner at one end of the tube. Due to the corrugation the heat transferring surfaces of the tube are increased, thus that a good heat transfer to the oven atmosphere is achieved, and which moves downwards through the annular, tapering space 21 in which the tube 22 is provided.

In this manner and by means of this design is achieved a good heating of the oven atmosphere recirculating in the oven chamber, without need of increased electric consumption, and by appropriate adjustment (which is however no part of the present invention) it is possible easily to set required proportions of IR-radiation heat and convection heat in relation to the requirements in different applications and occations of use.

The invention may of course be modified and varied in comparison to the embodiment shown in the drawings and described in connection thereto. The flame of the gas burner thus must not be directed into a coiled channel with corrugations, which increase the heat transfer surface, but combustion can occur in a vessel of arbitrary shape. For some heat treatment purposes it is also possible to let the combustion take place in a vessel, the fume discharge from which opens in the oven atmosphere, and it is even possible, to let the combustion take place directly in the circulating oven atmosphere, in case the residual product from the combustion can not have a negative influence upon the heat treatment result or upon the goods to be heat treated.

What we claim is:

1. A device at a heat treatment oven of the type using a combination of radiation heat and convection heat, comprising:

an oven chamber;

a circulation channel, positioned outside the oven chamber;

means arranged for circulating atmosphere of the heat treatment oven through the oven chamber and the circulation channel and back to the oven chamber;

a single vessel positioned in the circulation channel to exchange heat with the oven atmosphere in the circulation channel and to allow combustion therein, the vessel being designed as a tubular channel comprising a coiled, corrugated tube; and a gas burner arranged at combustion to emit its flame directly into the vessel such that the direction of the flame at least partly coincides with the circulation channel.

2. A device according to claim 1, wherein the vessel is closed and provided with a fume outlet situated outside the heat treatment oven.

3. A device according to claim 1, wherein the tubular channel is arranged in a portion of the circulation channel, the tubular channel having an interior which is separated from the oven atmosphere and which at one end is connected to the gas burner, the gas burner directing its flame directly into the tubular channel, the tubular channel at its opposite end being connected to a fume discharge conduit.

4. A device according to claim 2, further comprising a fume fan connected to the fume outlet, the fume fan being arranged during operation to create a suction effect in the vessel.

5. A device according to claim 3, further comprising a fume fan positioned in the fume discharge conduit, the fume fan being arranged during operation to create a suction effect in the tubular channel.

* * * * *